United States Patent [19]
Chaban, Jr. et al.
[11] 4,229,154
[45] Oct. 21, 1980

[54] SPINNERET FOR THE PRODUCTION OF HOLLOW FILAMENTS

[75] Inventors: Castulo Chaban, Jr., Chattanooga, Tenn.; Curtis O. Hawkins, Cove City, N.C.

[73] Assignee: E. I. Du Pont de Nemours and Company, Wilmington, Del.

[21] Appl. No.: 27,027

[22] Filed: Apr. 4, 1979

[51] Int. Cl.[3] ..... B29C 25/00

[52] U.S. Cl. ..... 425/72 S; 264/177 F; 264/209; 425/464; 425/467

[58] Field of Search ..... 425/72 S, 382, 466, 425/467, 464; 264/177 F, 209

[56] References Cited

U.S. PATENT DOCUMENTS

| | | | |
|---|---|---|---|
| 3,075,242 | 1/1963 | Grafried | 264/177 F |
| 3,081,490 | 3/1963 | Heynen et al. | 264/177 F |
| 3,121,254 | 2/1964 | Heynen et al. | 264/177 F |
| 3,174,364 | 3/1965 | Sims | 264/177 F |
| 3,268,313 | 8/1966 | Burgman et al. | 264/177 F |
| 3,397,427 | 8/1968 | Burke et al. | 264/177 F |
| 3,585,684 | 6/1971 | McIntosh et al. | 264/177 F |
| 3,659,983 | 5/1972 | McLain et al. | 264/177 F |
| 3,686,377 | 8/1972 | Hays | 264/177 F |

FOREIGN PATENT DOCUMENTS

| | | | |
|---|---|---|---|
| 47-2041 | 1/1972 | Japan | 264/171 |

*Primary Examiner*—Jay H. Woo

[57] ABSTRACT

A spinneret for the production of hollow filaments that includes a cylindrical shaped insert swaged into each passage of the spinneret to effect a seal between the insert and spinneret. The insert is constructed to contain the polymer entirely within the insert to prevent leakage of polymer into the core gas supply passages of the spinneret.

2 Claims, 4 Drawing Figures

SPINNERET FOR THE PRODUCTION OF HOLLOW FILAMENTS

BACKGROUND OF THE INVENTION

This invention relates to spinnerets and, more particularly, to a spinneret for the production of hollow filaments from synthetic polymers.

There have been various types of spinnerets proposed for the spinning of hollow filaments, and generally these include an insert fitted in the spinneret passage to provide an annular space at its outlet for the formation of the sheath of the hollow filament. The interior of the filament is prevented from collapsing by introducing a gas or drawing air into the center of the filament by means of passageways in the insert.

While prior art efforts to obtain a satisfactory spinning nozzle for the spinning of hollow filaments have been somewhat successful, the insert-type spinnerets of the prior art are susceptible to polymer leakage into the core fluid supply passageways because of a lack of a positive seal between the polymer and core supply fluid. For example, U.S. Pat. No. 3,397,427, of common assignee, discloses such a spinneret wherein a shaped insert is swaged into each passage of the spinneret to effect a seal between the insert and spinneret plate. In practice this design is subject to leakage of polymer into the air vent passages 34, 28 of the insert because thermal cycling during spinning operations, disassembly, cleaning and repair, and rebuilding causes expansion and contraction of the insert, breaking the swaged seal and allowing bottom surface 21 of the insert to come loose from shoulder 14 formed in the passage of the plate 11. Polymer then can leak into the air vent passages.

SUMMARY OF THE INVENTION

The present invention provides an improvement in the apparatus described in U.S. Pat. No. 3,397,427. In the apparatus claimed in the above-noted U.S. patent the construction, as pointed out above may permit polymer leakage into the core gas supply passages of the insert due to dislocation of the insert in the spinneret passageway.

In the improved apparatus of the present invention the insert extends the full length of the spinneret passages to eliminate the leakage propensity of the spinneret disclosed in the above-noted patent. More particularly, this invention involves a spinneret formed from two plates. These plates, when bolted together, have a cylindrical passage connecting the top surface of the upper plate with the bottom surface of the lower plate. The cylindrical passage is counterbored at the top surface of the upper plate. An insert is fitted in the cylindrical passage to form an extrusion orifice at the outlet of the passage. The insert is a cylinder coextensive with the cylindrical passage and has a flange that fits into the counterbore formed in the top surface of the upper plate. The insert has a first axial bore partially through it from one end and a second bore, coaxial with the first, partially through it from the other end of the insert. The first and second bores are separated by a median member which has a plurality of radially spaced holes in communication with the first and second axial bores. An inflation member projects from a central location on said median member into said second bore and terminates at the exit end of the insert. The contiguous surfaces of upper and lower plates have matching recesses so that when they are bolted together, a chamber is formed in the interior of the spinneret plate assembly for passage of inflation fluid to each insert. This chamber is fed with inflation fluid through a plurality of inlet bores present in one or the other plates and connected with the chamber, thus assuring essentially equal inflation fluid pressure at each insert. The communicating passageways in the plate, the median member of the insert, and the inflation member supply inflation fluid to the interior of the hollow filament formed by extruding plastic material through the passage of the spinneret. A cup-shaped member with a central bottom opening is inserted in the second bore and in conjunction with the inflation member forms an orifice at the exit end of the insert.

DETAILED DESCRIPTION OF THE PREFERRED EMBODIMENT

Figure 1:
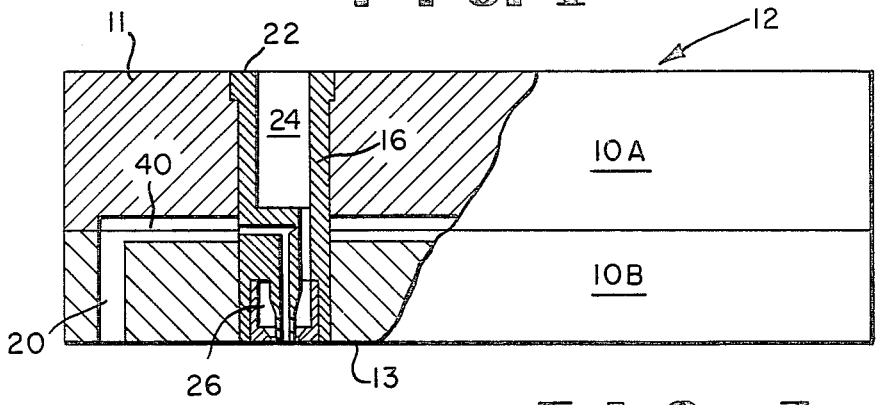
FIG. 1 is a view partially in section through a spinneret according to the invention.
Figure 2:
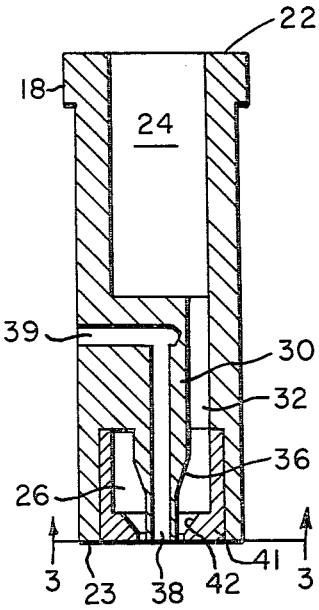
FIG. 2 is an enlarged cross sectional elevation view of the insert of FIG. 1.
Figure 3:
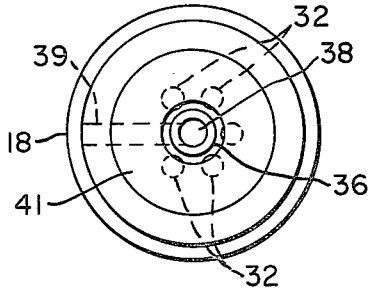
FIG. 3 is a bottom view of the insert of FIG. 2 taken along line 3–3.
Figure 4:
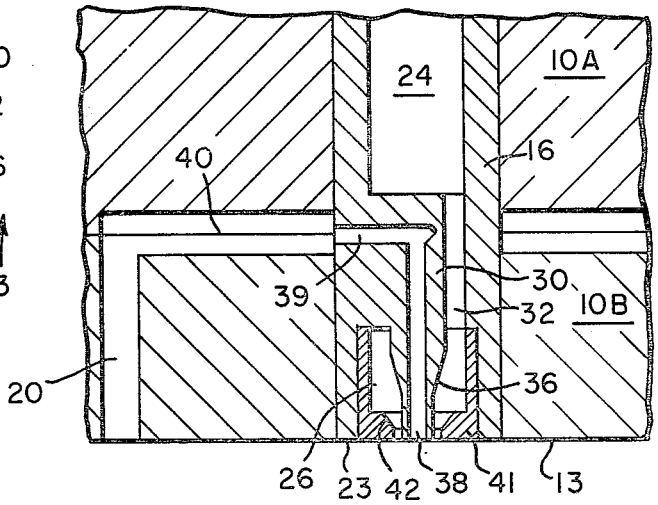
FIG. 4 is an enlarged view of a portion of FIG. 1.

Referring to the drawing, spinneret 12 which is adapted to be mounted in a conventional filter pack for supplying a polymer composition to be spun into a filament is formed from plates 10A and 10B having upper and lower surfaces 11, 13, respectively, connected by a cylindrical passage. A cylindrical insert 16 is coextensive with the passage and has a flange 18, extending from it near one end 22 of the insert. The flange fits into a counterbore in the surface 11 of plate 10A and the insert is swaged into the passage and precisely located by the flange 18. The insert includes a first axial bore 24 partially through it from the end 22 and a second bore 26 coaxial with the first bore partially through the insert from its other end 23. The two bores 24, 26 are separated from each other by a median member 30 which has a plurality of holes 32 that are equispaced radially from the axis of bore 24 and pass through the median member in communication with bores 24, 26. An inflation member 36 projects from a central location on the median member 30 into the second axial bore 26 and terminates at the end 23 of the insert. The inflation member 36 is provided with an axial passageway 38 which connects to a lateral passageway 39 in the median member 30. When the insert 16 is fitted into the spinneret as shown in FIGS. 1 and 4, the chamber 40 formed by matching recesses in plates 10A and 10B is aligned with the lateral passageway 39 in the median member 30 of the insert. A plurality of inlet bores 20 (only one shown) leads from a source of fluid supply through the lower plate 10B to supply chamber 40. This combination of passageways 20, 38, 39 and chamber 40 (which connects to all inserts) provides a continuing passageway to supply fluid to the interior of the hollow filament. A cup-shaped member 41 having a central bottom opening 42 surrounding the end of the inflation member 36 is fitted into said second bore to form an annular orifice at the exit end of the spinneret through which polymer is extruded.

In operation, the molten polymer composition moves initially into bore 24 of insert 16, then is uniformly distributed through holes 32 and passes through the bore 26 of the insert 16 and annular orifice formed at the exit end of the insert 16 to form a hollow filament. As the polymer coalesces around the exit end of insert 16, a partial vacuum is formed causing a gravity flow of room air through inlet bore 20, chamber 40, and passageways 39, and 38 into the center of the filament. The percentage of filament void can be controlled by inflation fluid pressure applied to chamber 40, capillary geometry, polymer viscosity and the rate of spinning and quenching. While in the preferred embodiment of this invention the holes 32 are shown equispaced radially, it is also comprehended that they may also be equispaced both radially and circumferentially. The spinneret of this invention may be made from metals known in the art, such as stainless-steel or platinum group metals.

The condensation polymers and copolymers, for example, polyesters, polyamides, and polysulfonamides, and particularly those that can be readily melt-spun, are preferred in the practice of this invention. It is obvious that gas, preferably inert, may be used rather than room air to yield hollow filaments. It is also obvious that, while this invention has been illustrated for round cross-section filaments, other filaments whose outer surface cross-sections are nonround (i.e. trilobal, tetralobal, serrated, etc.) may be produced by using an appropriately slotted capillary cup.

While the inlet bores 20 have been illustrated as being present in the lower plate, it is understood that inflation gas may be supplied to chamber 40 through inlet bores through upper plate 10A into chamber 40.

The spinneret of this invention has the advantage of being simple in construction while providing a means to contain the polymer flow entirely within the insert to prevent leakage of polymer into the core gas supply passages 38, 39, and 40 of the spinneret.

We claim:

1. A spinneret for the production of hollow filaments comprising: upper and lower plates having contiguous surfaces, said contiguous surfaces having matching cavities to form a chamber, the top surface of the upper plate and the bottom surface of the lower plate being connected by a cylindrical passage, the cylindrical passage being counterbored at the top surface of the upper plate; and a cylindrical insert coextensive with said passage, said insert having a flange at one end that fits into the counterbore in the top surface of the upper plate, said top surface being swaged into said one end, said insert having a first axial bore partially through it from said one end and a second bore coaxial with said first bore partially through it from the other end of the insert, said first and second bores being separated by a median member having a plurality of radially spaced holes in communication with said first and second bores thereby providing a flow path through the spinneret within the insert; an inflation member projecting from a central location on said median member into said second axial bore, said inflation member having an axial passageway in communication with a passageway through said median member which in turn is connected with a source of gas.

2. The spinneret of claim 1, including a cup-shaped member having a central bottom opening, said cup-shaped member being fitted into said second bore with its central bottom opening surrounding said inflation member to form an orifice at the exit of said spinneret.

* * * * *